US009700166B2

(12) United States Patent
Farentinos et al.

(10) Patent No.: US 9,700,166 B2
(45) Date of Patent: Jul. 11, 2017

(54) IMPACT-RESISTANT MAILBOX

(71) Applicant: ARCHITECTURAL MAILBOXES, LLC, Redondo Beach, CA (US)

(72) Inventors: Christopher Andrew Farentinos, Redondo Beach, CA (US); Craig Ronald Steele, Hawthorne, CA (US); Raffy Michael Arce-Paje, Torrance, CA (US)

(73) Assignee: ARCHITECTURAL MAILBOXES, LLC, Redondo Beach, CA (US)

( * ) Notice: Subject to any disclaimer, the term of this patent is extended or adjusted under 35 U.S.C. 154(b) by 0 days.

(21) Appl. No.: 14/963,107

(22) Filed: Dec. 8, 2015

(65) Prior Publication Data

US 2016/0157654 A1 Jun. 9, 2016

Related U.S. Application Data

(60) Provisional application No. 62/089,740, filed on Dec. 9, 2014.

(51) Int. Cl.
*A47G 29/122* (2006.01)

(52) U.S. Cl.
CPC ..... *A47G 29/1209* (2013.01)

(58) Field of Classification Search
CPC ..... A47G 29/1209; A47G 29/1206; A47G 29/122; B21D 51/28; B21D 51/30; B21D 51/32
USPC ..... 232/38, 17, 45, 39; 413/2, 4, 6
See application file for complete search history.

(56) References Cited

U.S. PATENT DOCUMENTS 2,578,691 A * 12/1951 Gieseler ..... A47G 29/12 232/17
4,275,829 A * 6/1981 Johnson ..... A47G 29/1209 220/4.34
4,368,842 A * 1/1983 DeLange, III ..... A47G 29/1209 232/17
4,540,323 A * 9/1985 Inoue ..... B21D 51/32 413/36
4,626,158 A * 12/1986 Le Bret ..... B21D 51/2615 413/4
5,499,438 A * 3/1996 Schutz ..... B65D 77/0466 29/407.01
5,575,422 A * 11/1996 Peterman ..... A47G 29/1209 232/17
6,729,535 B2 * 5/2004 Lackey ..... A47G 29/1209 232/17
6,811,076 B1 * 11/2004 Engberg ..... A47G 29/1209 232/38
7,070,090 B2 * 7/2006 Ranen ..... A47G 29/1209 232/17
7,086,581 B1 * 8/2006 Lackey ..... A47G 29/1216 232/1 C
7,350,692 B2 * 4/2008 Bushee ..... A47G 29/1212 232/17

(Continued)

*Primary Examiner* — William Miller
(74) *Attorney, Agent, or Firm* — Vista IP Law Group LLP

(57) ABSTRACT

A mailbox with improved structural rigidity and improved impact resistance over previous mailboxes includes one or more of a rod at least partially within a rolled front edge of the mailbox, use of the mailbox floor to improve structural integrity, such as by rolling the body and floor edge together, rolling the body edge and sliding a flanged floor into the roll, or hemming the floor and body together, and/or a front door impact brace.

15 Claims, 11 Drawing Sheets

(56) References Cited

U.S. PATENT DOCUMENTS

| | | | | |
|---|---|---|---|---|
| 7,611,043 | B2 * | 11/2009 | Black | A47G 29/1216 232/38 |
| 2013/0061499 | A1 * | 3/2013 | Berglund | A47G 29/1209 40/607.1 |

* cited by examiner

IMPACT-RESISTANT MAILBOX

CROSS-REFERENCE TO RELATED APPLICATIONS

This Application claims the benefit of U.S. provisional Application No. 62/089,740, filed on Dec. 9, 2014, in accordance with 35 U.S.C. Section 119(e), and any other applicable laws. The contents of the aforementioned application(s) are hereby incorporated herein by reference in their entirety as if set forth fully herein.

BACKGROUND

The field of the invention generally relates to mailboxes, and more specifically to mailboxes having improved structural rigidity and improved impact resistance over common mailboxes.

Curbside mailboxes used in the United States today must undergo and pass testing against United States Postal Service (USPS) Standard 7, and be approved by the United States Postal Service ("USPS") engineering team. Section 4 of USPS Standard 7 (currently revision C) includes two requirements of particular interest, namely Section 4.8 (Structural Rigidity) and Section 4.9 (Impact Test).

USPS Standard 7 identifies the static load and impact locations for these tests, describing how to perform them, and how to evaluate compliance. A paraphrased excerpt follows, with reference to FIG. 1. The "Position Numbers" (#1-#6) shown in FIG. 1 are referenced throughout this patent application as such. An excerpt from USPS Standard 7 is provided below:

1. Strength Test:
   a. Apply the load #1 onto bolster plate as in figure.
   b. Hold for 1 minute.
   c. Remove load.
   d. Measure permanent deformation. Permanent deformation must not exceed the amount stated in the table.
   e. Repeat for locations #2 through #5.

| Position | Max. Deformation (inches) | Load (lbs) |
|---|---|---|
| 1 | ⅛ | 200 |
| 2 | ⅛ | 200 |
| 3 | ⅛ | 50 |
| 4 | ⅛ | 50 |
| 5 | ⅛ | 100 |

2. Impact Test:
   a. Drop 10 lb weight onto position #3 from a height of 3 feet using a 2"×2" bolster plate.
   b. Observe closely inside and outside for any perforation (hole), crack, sharp edges, and door operation. There must not be any such perforations, cracks, or sharp edges, and the door must still operate normally.
   c. Repeat for position #4.

SUMMARY

The present invention is directed to a mailbox with improved structural rigidity and improved impact resistance over common mailboxes. For instance, the mailbox of the present invention includes embodiments designed to meet and often exceed the requirements of USPS Standard 7.

In one embodiment of the present invention, a mailbox includes a body having a top (e.g., an arched top) and sidewalls extending downward from the top to form a cover of the mailbox. The front of the body has a rolled front edge. A front door is rotatably coupled to the body at the front of the body. The front door is rotatable between an open position and a closed position. A rod is at least partially disposed within the rolled front edge of the mailbox. The rod reinforces the body of the mailbox thereby increasing the strength and impact resistance of the mailbox.

In another embodiment of the present invention, a mailbox includes a body having a top (e.g., an arched top) and sidewalls extending downward from the top to form a cover of the mailbox. The sidewalls have a body edge along the length of the bottom of the sidewalls. A floor is coupled to the body to form a floor of the mailbox. The floor has a bottom portion and opposing side flanges extending downward from the bottom portion on first and second opposing sides along a length of the floor. Each side flange has a floor edge at the lower end of the respective side flange. Each floor edge is adjacent, and interior to, a respective portion of the body edge. Each floor edge is rolled together with the respective portion of the body edge. Rolling the floor edges together with the body edge effectively connects the body to the floor along the entire length of the body and the floor, thereby increasing the strength and rigidity of the mailbox.

In still another embodiment, the mailbox is similar to the preceding embodiment, except that the body edge has a rolled edge along the length of the mailbox and each floor edge has a flange. Each flange of the floor edge is disposed within a respective portion of the rolled edge thereby retaining the floor edge within the rolled edge. Each flange may be inserted into the respective portion of the rolled edge by sliding the flange into the respective rolled edge.

In still another embodiment, the mailbox is similar to the two preceding embodiments except that each floor edge is hemmed together with a respective portion of the body edge by folding the floor edges together with the body edge.

In an additional aspect, any of the preceding embodiments of a mailbox may also include a front door impact brace. The impact brace is attached to an inside of the front door and is positioned to engage the body during an impact to the mailbox.

In another aspect, the floor may also include a floor front flange at a front of the mailbox adjacent the front door. Similar to the side flanges, the floor front flange extends downward from the floor. The floor front flange is connected to the side flanges and to a portion of the body edge. The connection of the floor front flange to the side flanges and to the body edge further increases the strength and rigidity of the mailbox.

In other aspects of the present invention, alternative to, or in addition to, the above methods of connecting the side flanges to the sidewalls of the body, a tab and slot and/or one-way body notches and tabs may be utilized to connect the side flanges of the floor to the sidewalls of the body.

The above-identified embodiments may be combined in various combinations as desired.

BRIEF DESCRIPTION OF THE DRAWINGS

The foregoing and other aspects of embodiments are described in further detail with reference to the accompanying drawings, wherein like reference numerals refer to like elements and the description for like elements shall be applicable for all described embodiments wherever relevant.

DETAILED DESCRIPTION

Figure 2:
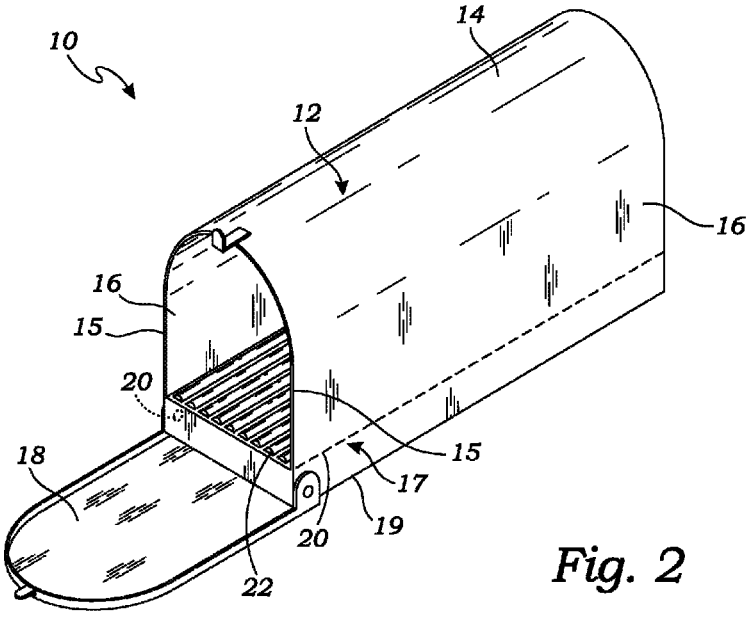
FIG. 2 is a side, perspective view of a mailbox, according to one embodiment of the present invention.
Figure 3:
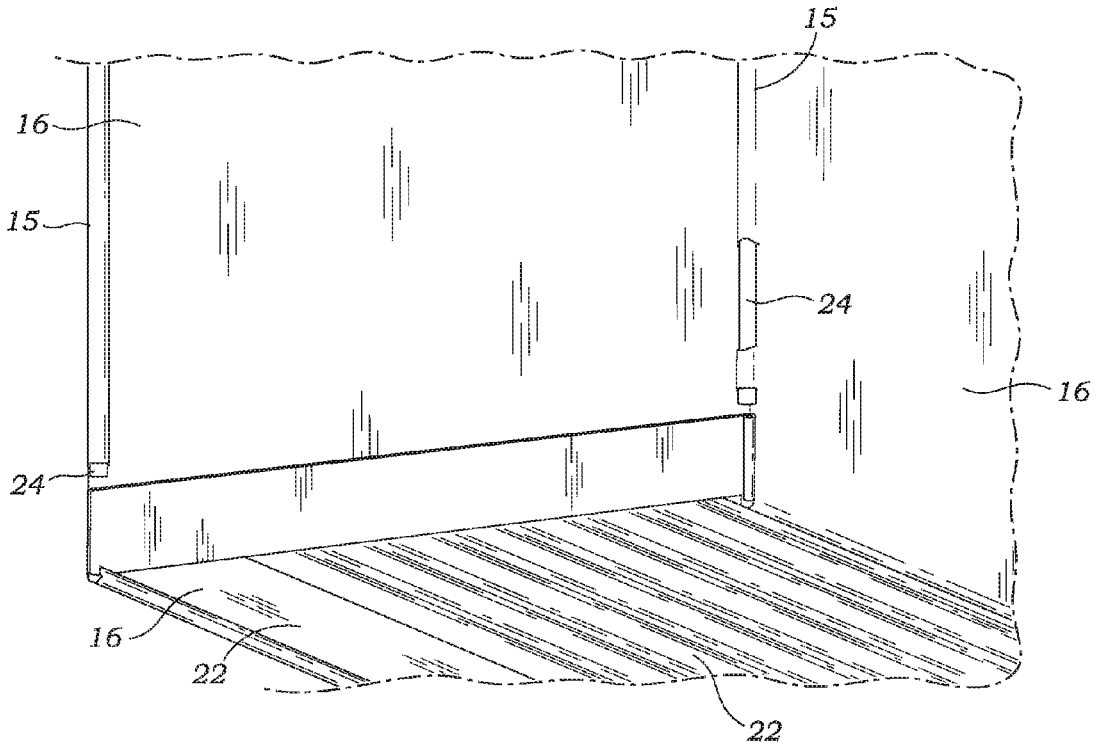
FIG. 3 is a partial, perspective, side view of a mailbox (with the front door not shown for illustration purposes), having a rod at least partially inside the rolled front edge of a body of a mailbox, according to one embodiment of the present invention.

Referring to FIGS. 2 and 3, one embodiment of a mailbox 10 according to the present invention is shown. FIG. 2 illustrates an example of a complete mailbox 10, while FIG. 3 shows just the front, portion of the mailbox 10 looking at the front from slightly below the mailbox 10 to show the bottom surface of the mailbox and with the front door not shown in order to reveal the interior of the mailbox 10. The mailbox 10 comprises a body 12 having a top 14 and sidewalls 16 extending downward from the top 14. Each sidewall 16 has a body edge 17 comprising a lower portion of the sidewall 16 and the bottom edge 19 of each sidewall 16 extending along the length of each sidewall 16. The top 14 may have an arched shape, as shown in this exemplary embodiment, or any other suitable shape. The front of each sidewall 16 also has a front edge 15 which extends upward from the bottom edge 19 to the front edge of the top 14.

The front door 18 is rotatably coupled to the front of the body 12 using two hinges 20, with one hinge 20 located on the opposing sides of the body 12.

A floor 22 is coupled to the inside of the body edge 17 of the body 12. The floor 22 may be coupled to the body edge 17 of the body 12 by any suitable method, including the methods described below. For example, the floor 22 may be coupled to the body edge 17 by using fasteners, welding, adhesive, the methods described below such as rolling a floor edge 36 with the body edge 17 (as described below), hemming the floor edge 36 with the body edge 17 (as described below), etc.

Referring to FIG. 3, the front edge 15 of each sidewall 16 of the body 12 is rolled to form a rolled front edge 15. In the embodiment of FIG. 3, the front edge 15 is rolled inward to form a rolled front edge 15 to the inside of each sidewall 16. The front edge of the top 14 may also be rolled along with the sidewalls 16. Alternatively, one or both front edges 15 of the sidewalls 16 may be rolled to the outside thereby forming a rolled front edge to the outside of the respective sidewall 16. The rolled front edges 15 form an elongated, substantially cylindrical structure. A reinforcing rod 24, or two or more reinforcing rods 24, is at least partially disposed within the rolled front edges 15. The reinforcing rod 24 extends a desired length of the rolled front edge 15, which may be the entire length of the rolled front edge, or a portion of the length of the rolled front edge 15, such as at least half the length of the rolled front edge 15. For example, a single reinforcing rod 24 may extend from a first rolled front edge 15, through the rolled edge of the top, and through the opposing rolled front edge 15. Alternatively, a first reinforcing rod 24 may be disposed in a first rolled front edge 15, and a second reinforcing rod 24 may be disposed in the opposing rolled front edge 15.

The rods 24 may be made from any suitable material, depending on the specific application. For example, the rods 24 in various applications (or even within the same application) may have various strengths, stiffnesses, densities, corrosion resistance, and/or ductilities. Some materials may not be easily formed into the arched shape of the top 14 while inside the rolled edge of the top 14. For such materials, it may be necessary to use an assembly method other than simply inserting the rod 24 into the fully formed rolled edges. For example, the body 12 can be formed by first partially rolling the front edges with the raw material in a flat shape (i.e., prior to forming the arched top 14), then bending the material to form the arched top 14, then inserting a preformed rod 24 having a shape matching the shape of the front edges into the partially rolled front edges, and then finally completing the roll to trap the rod 24 inside the rolled front edges. Multiple rods may also be used as needed to strengthen various portions of the rolled edges at strategic locations to dictate or influence where the mailbox bends as a result of testing.

Figure 4:
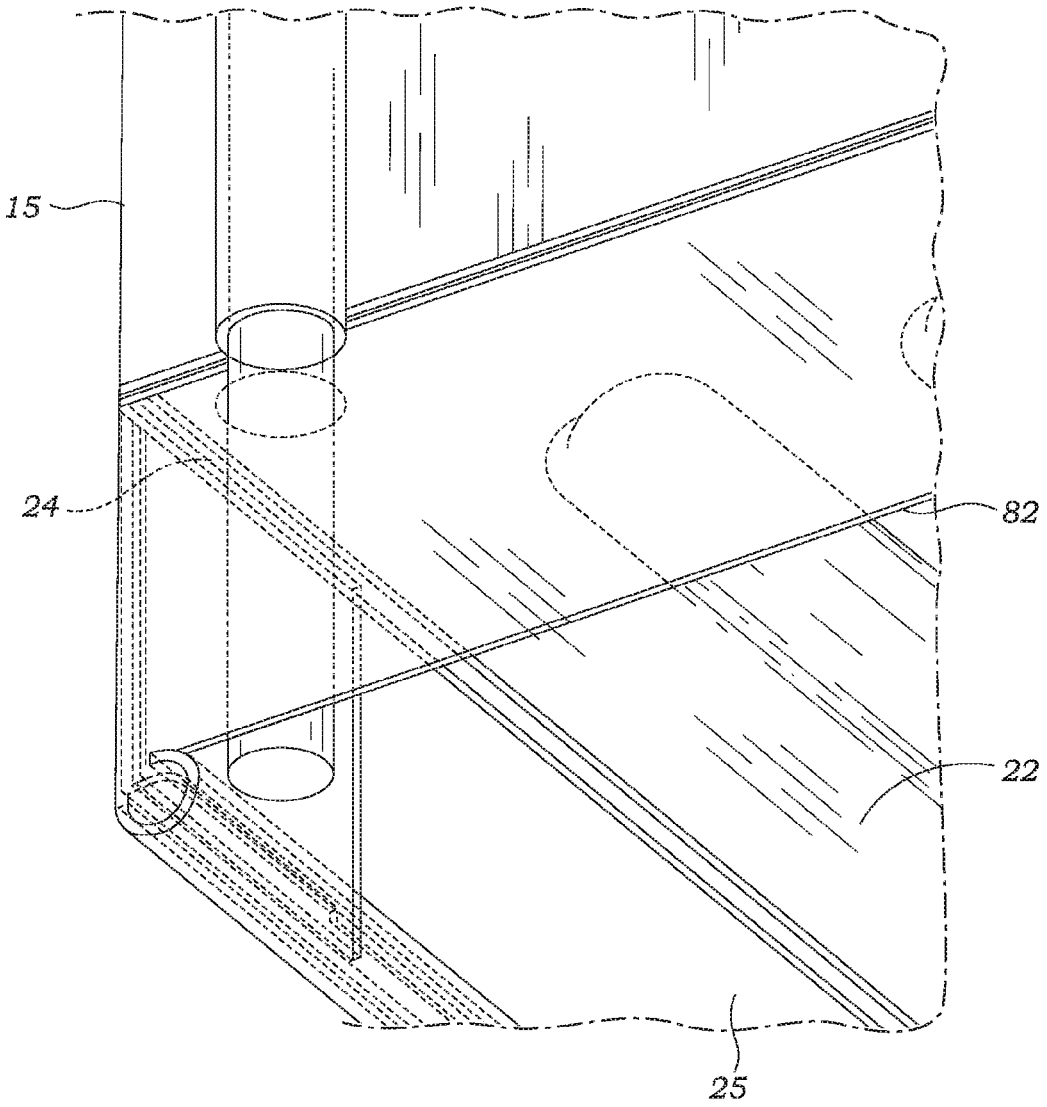
FIG. 4 is an enlarged, partial view of the mailbox of FIG. 2 showing the rod extending through the floor of the mailbox, according to one embodiment of the present invention.

Turning to FIG. 4, in another aspect, the reinforcing rods 24 may be connected to other parts of the mailbox 10 to further increase the strength and rigidity of the mailbox 10. In one way, the rods 24 may extend beyond the bottom end of the rolled front edges 15. The extension part of each rod 24 may then be connected to the floor 22, and/or other parts of the body besides the rolled front edges 15. As shown in FIG. 4, the rod 24 may be connected to a side of the floor 22, to a floor front flange 82 extending downward from the front edge of the floor 22, and/or to the body edge 17 by any suitable means, such as welding, adhesive, fasteners, connectors, etc.

In another feature, the rod(s) 24 may be magnetized such that they serve as an integral door closure. The magnetized rods 24 hold the front door closed by a magnetic field force between the magnetized rods 24 and a magnetizable material in the front door 18. In this manner, when the front door 18 is rotated toward the closed position, the magnetic field of the magnetized rods 24 forces the front door 18 towards the fully closed position, and also exerts a magnetic force tending to retain the front door 18 in the closed position.

Figure 1:
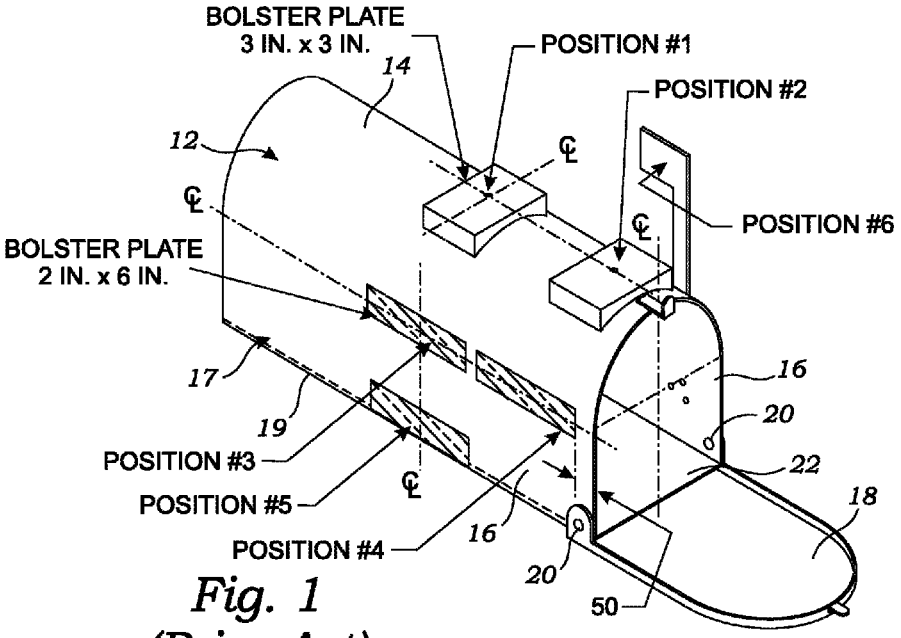
Fig. 1 (Prior Art)
FIG. 1 shows a typical mailbox from the prior art with position numbers and bolster plates identified for reference to USPS Standard 7.
Figure 5:
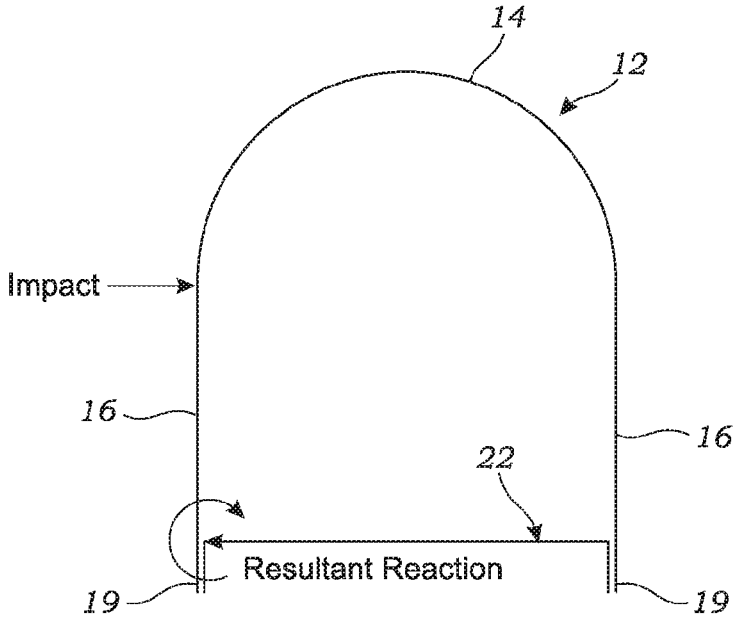
FIG. 5 illustrates a resultant reaction along the edge of the floor of a mailbox when impact occurs at locations #3 and #4 as shown in FIG. 1.
Figure 6:
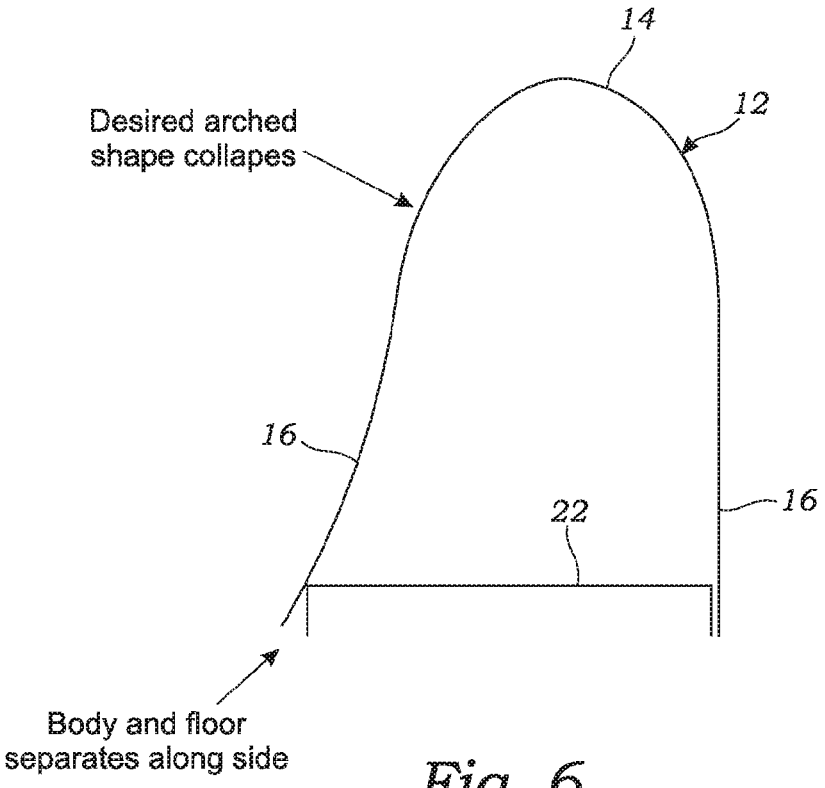
FIG. 6 illustrates collapse of the sidewall of a typical mailbox when impact occurs at locations #3 and #4 as shown in FIG. 1.

Turning to FIG. 5 and FIG. 6, these schematics illustrate an inherent weakness in current mailbox designs. As shown in FIG. 5, an impact at Position #3 and Position #4 of a typical mailbox (as shown in FIG. 1) causes a resultant reaction along the edge of the mailbox floor. Current mailbox designs have insufficient connection between the bottom edge 19 of the sidewalls 16 of the body 12 or between the side edge 84 (see FIG. 12) of the front flange 82 of the floor 22 and the sidewalls 16 of the body 12 along the edge. As a result, the floor 22 may easily separate from the body 12, and more easily collapse. The entire mailbox shape may also be distorted as shown in FIG. 6, thus rendering the mailbox non-functional and non-compliant with Standard 7, as described above.

Accordingly, several embodiments of the present invention include more effectively connecting the body 12 and floor 22 along the entire length of the body 12, and/or at the critical front area of the mailbox, which helps retain the overall shape of the mailbox 10 upon an impact, such as an impact as Position #3 and/or Position #4.

Figure 7:
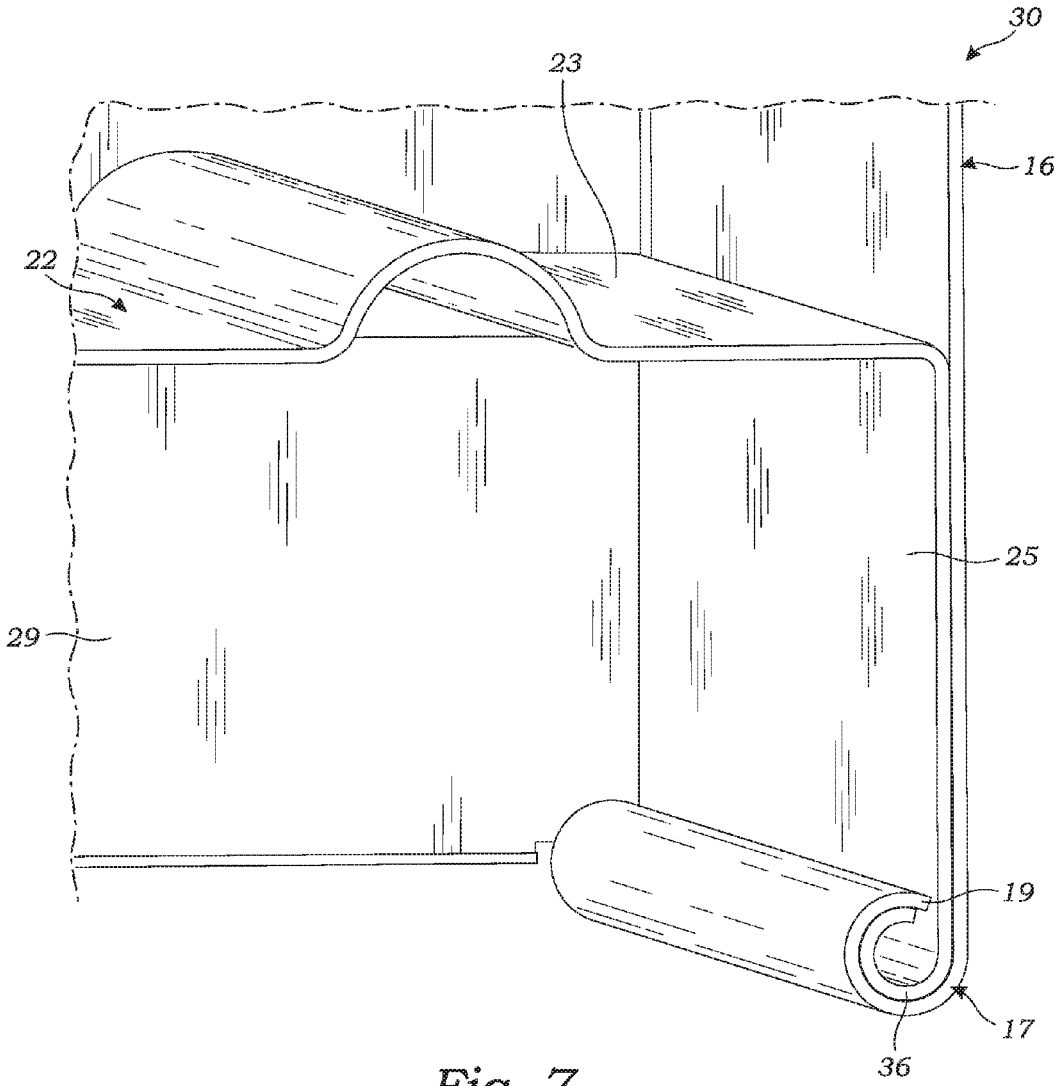
FIG. 7 is a perspective, side view of a portion of a mailbox having the body edge and the floor edge rolled together, according to one embodiment of the present invention.

Turning to FIG. 7, in another embodiment of a mailbox 30 according to the present invention, each body edge 19 of the body 12 is rolled together with a respective floor edge 36 of a side flange 25 of the floor 22. The mailbox 30 includes all of the basic features of the mailbox 10 described above, except that it may or may not include the rolled front edges and rod(s) 24. FIG. 7 includes only a partial view of the mailbox 30 showing the rear, right-hand corner (right as viewed from the front of the mailbox) of the mailbox 30 as viewed from inside of the mailbox 30, and showing the inside of the back panel 29 of the mailbox 30. It is understood that that the rear, left-hand corner of the mailbox 30 is substantially a mirror image of the rear, right-hand corner of the mailbox 30, and that the remainder of the mailbox extending forward from the partial view is the same, or substantially similar to the mailbox 10 shown in FIG. 2.

As shown in FIG. 7, the floor 22 has a floor top 23 and a side flange 25 extending downward from the edge of the floor bottom 23 along the length of the floor 22. Of course, the left side of the floor 22 (not shown) has an opposing side flange (not shown) mirroring the right side flange 25. Each side flange 25 has a floor edge 36 at the lower end of the respective side flanges 15. Each of the floor edges 36 is adjacent, and interior to, the respective body edge 17. Each floor edge 36 is rolled together with the respective body edge 17 along the entire length of the floor 22 (and the length of the body 12) thereby connecting the floor edges 36 to the respective body edges 17 along the entire length of the floor 22.

Figure 8:
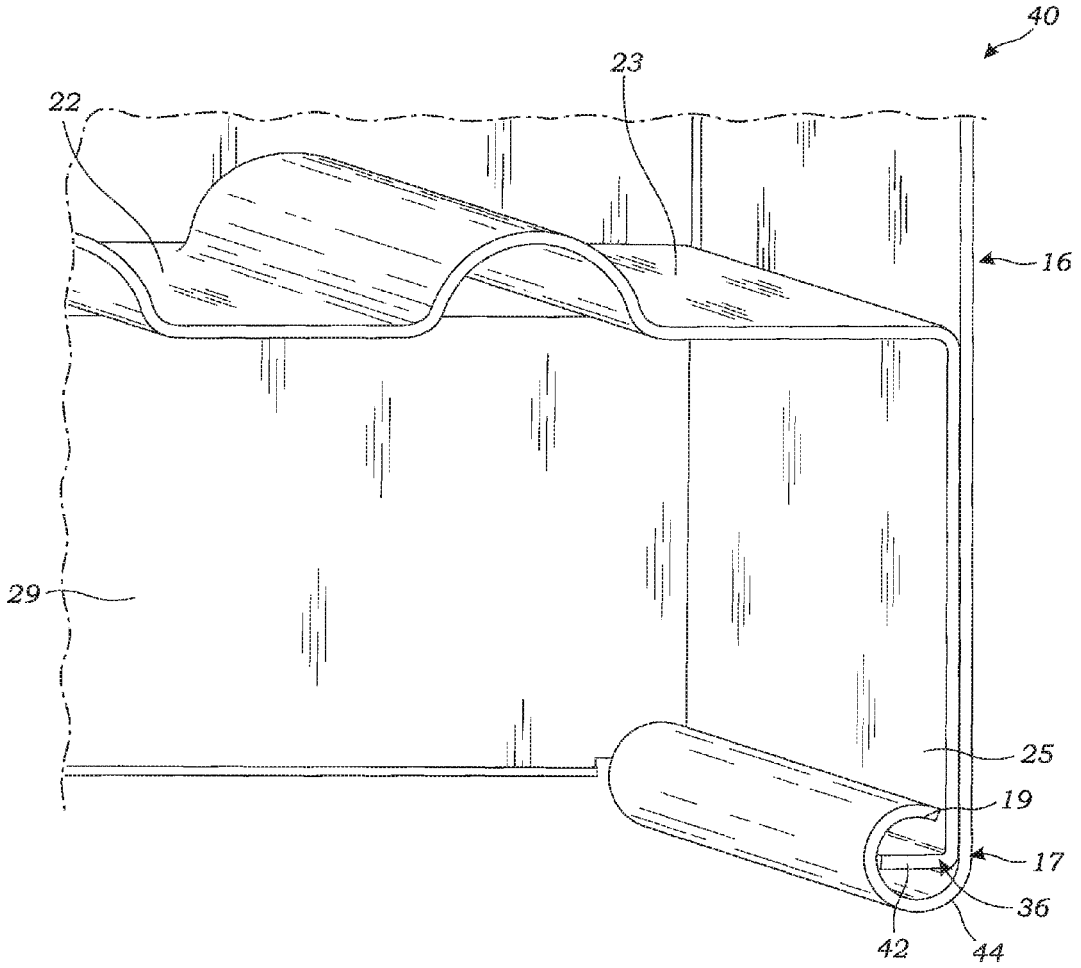
FIG. 8 is a perspective, side view of a portion of a mailbox having the body edge rolled, and a flanged portion of a floor flange inserted therein, according to one embodiment of the present invention.

Turning to FIG. 8, another embodiment of a mailbox 40 according to the present invention is shown. The mailbox 40 is substantially the same as mailbox 30 described above, except that the each of the floor edges 36 include a floor edge flange 42 which is disposed within a respective rolled body edge 44. Again, the mailbox 40 includes all of the basic features of the mailbox 10 described above, except that it may or may not include the rolled front edges and rod(s) 24. Similar to FIG. 7, FIG. 8 includes only a partial view of the mailbox 40 showing the rear, right-hand corner (right as viewed from the front of the mailbox) of the mailbox 40 as viewed from inside the mailbox 40, and showing the inside of the back panel 29 of the mailbox 40; the rear, left-hand corner of the mailbox 40 is a mirror image of the rear, right-hand corner of the mailbox 40, and the remainder of the mailbox extending forward from the partial view is the same, or substantially similar to the mailbox 10 shown in FIG. 2.

As illustrated in FIG. 8, each body edge 17 of the sidewalls 16 is rolled to form a rolled body edge 44 along the entire length of the sidewalls 16 (i.e., along the entire length of the body 12). Each of the floor edges 36 has floor edge flange 42 extending the length of the floor 22. The floor edge flanges 42 may comprise a bend in the floor edges 36, such as a right angle bend, or other suitably angled bend. The floor edge flanges 42 are disposed within a respective rolled body edge 44, thereby connecting the floor edges 36 to the respective body edges 17 along the entire length of the floor 22.

Figure 9:
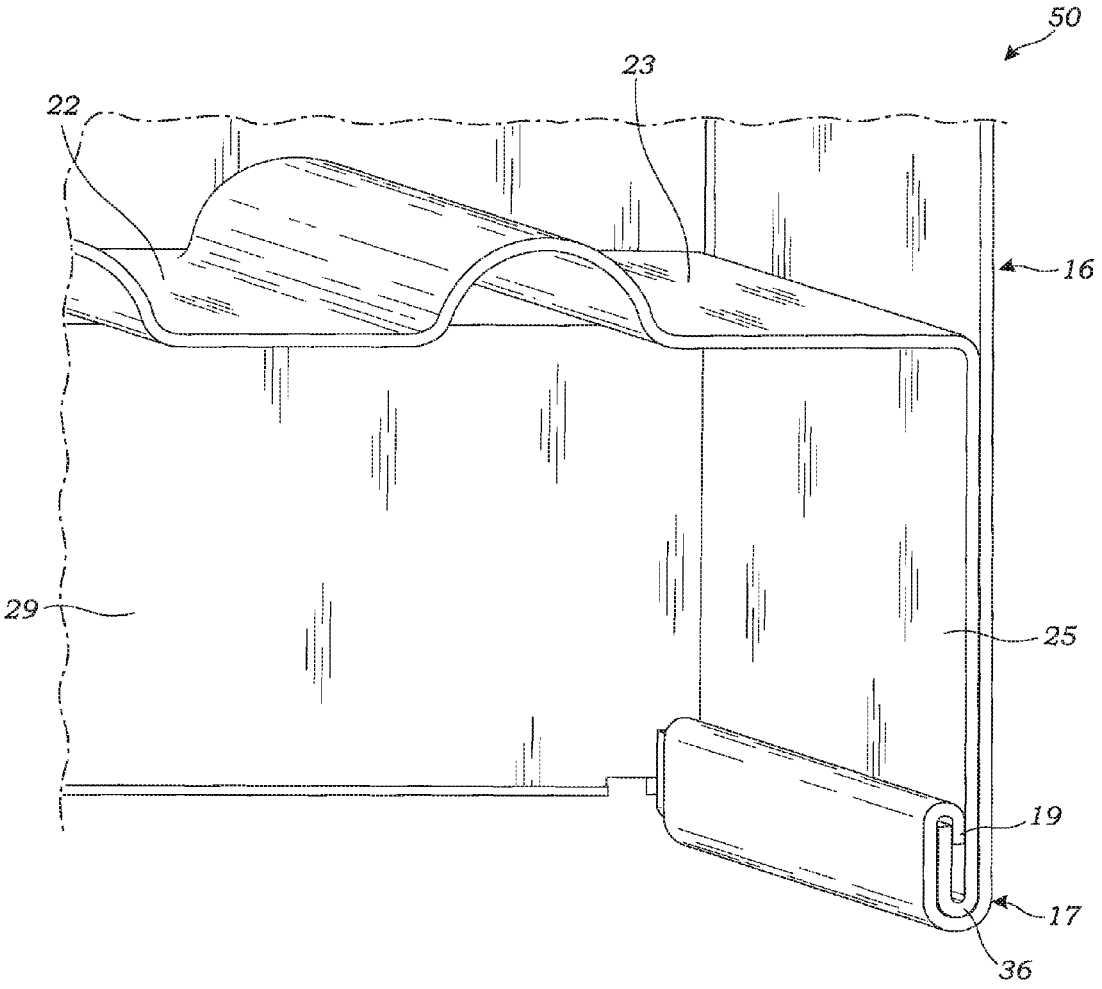
FIG. 9 is a perspective, side view of a portion of a mailbox having the body edge and the floor edge hemmed together, according to one embodiment of the present invention.

Referring now to FIG. 9, another embodiment of a mailbox 50 according to the present invention is shown. The mailbox 50 is substantially the same as mailboxes 30 and 40 described above, except that each body edge 19 of the body 12 is hemmed together with a respective floor edge 36 of a side flange 25 of the floor 22. The mailbox 50 includes all of the basic features of the mailbox 10 described above, except that it may or may not include the rolled front edges and rod(s) 24. FIG. 9 includes only a partial view of the mailbox 50 showing the rear, right-hand corner (right as viewed from the front of the mailbox) of the mailbox 50 as viewed from inside the mailbox 50, and showing the inside of the back panel 29 of the mailbox 50. It is understood that that the rear, left-hand corner of the mailbox 50 is substantially a mirror image of the rear, right-hand corner of the mailbox 50, and that the remainder of the mailbox 50 extending forward from the partial view is the same, or substantially similar to the mailbox 10 shown in FIG. 2.

As shown in FIG. 9, the floor 22 has a floor bottom 23 and a side flange 25 extending downward from the edge of the floor bottom 23 along the length of the floor 22. Of course, the left side of the floor 22 (not shown) has an opposing side flange (not shown) mirroring the right side flange 25. Each side flange 25 has a floor edge 36 at the lower end of the respective side flanges 15. Each of the floor edges 36 is adjacent, and interior to, the respective body edge 17. Each floor edge 36 is hemmed together with the respective body edge 17 along the entire length of the floor 22 (and the length of the body 12) thereby connecting the floor edges 36 to the respective body edges 17 along the entire length of the floor 22. The hem may include 1, 2, 3 or more folds of each floor edge 36 with the respective body edge 17.

Figure 10:
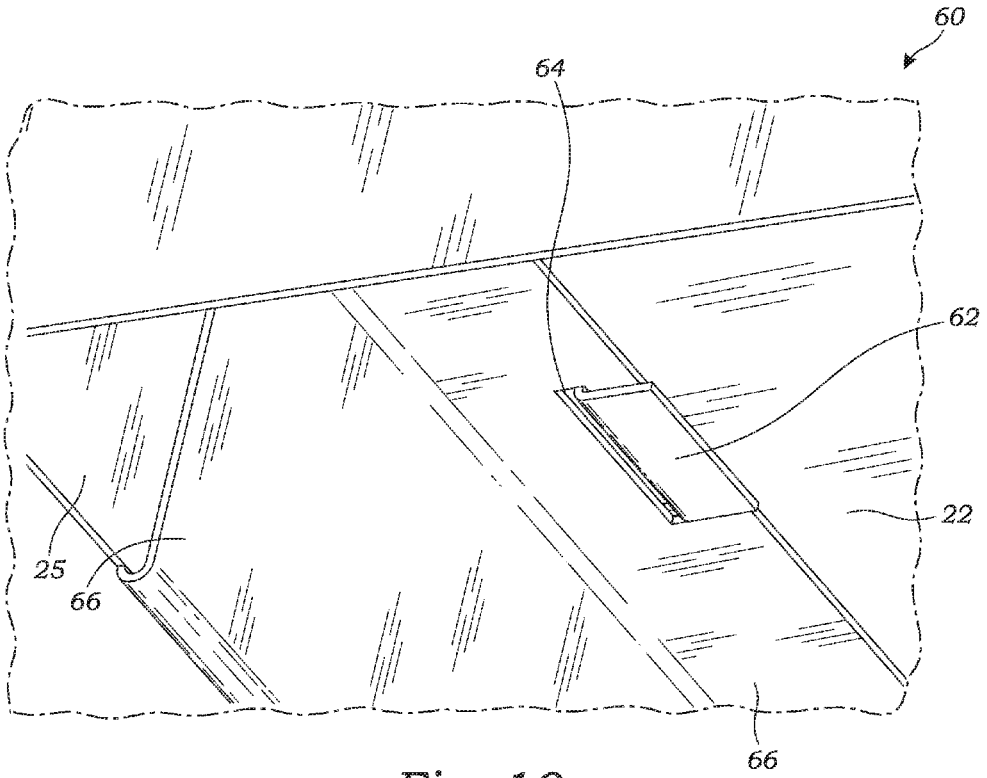
FIG. 10 is a perspective, side view of a portion of a mailbox having a sidewall of the body connected to the floor flange using a tab and slot configuration, according to one embodiment of the present invention.

Turning to FIG. 10, in another embodiment of a mailbox 60 according to the present invention, a tab 62 and slot 64 are used to connect the floor 22 to the sidewalls 16 of the body 12. The mailbox 60 includes all of the basic features of the mailbox 10 described above, except that it may or may not include the rolled front edges and rod(s) 24. In addition, the mailbox 60 may include any of the compatible features of the mailboxes 30, 40 and 50. FIG. 10 includes only a partial view of the mailbox 60 showing the front, left-hand corner (left as viewed from the front of the mailbox) of the mailbox 60 as viewed from the front and below the mailbox 60. It is understood that that the front, right-hand corner of the mailbox 60 is a mirror image of the front, left-hand corner of the mailbox 60, and that the remainder of the mailbox 60 extending back from the partial view is the same, or substantially similar to the mailbox 10 shown in FIG. 2.

As shown in FIG. 10, each sidewall 16 is folded over the side flange 25 in a "U" shape. A sidewall extension 66 of the sidewall 16 extends upward to the bottom side of the floor 22 and then bends at a perpendicular angle such that it extends parallel to the floor 22. The tab 62 is connected to the bottom side of the floor 22 and extends slightly away from the bottom side of the floor 22. The sidewall extension 66 has the slot 64 opposing the tab 62 which receives the tab 62 in order to couple the tab 62 to the slot 64. The mailbox 60 may have a plurality of these tab 62 and slot 64 structures spaced apart along the length of the floor 22 and sidewalls 16. Thus, the tab 62 and slot 64 enhance the structural connection between the floor 22 and the sidewalls 16 which increases the strength and rigidity of the mailbox 60 and improves its impact resistance.

Figure 11:
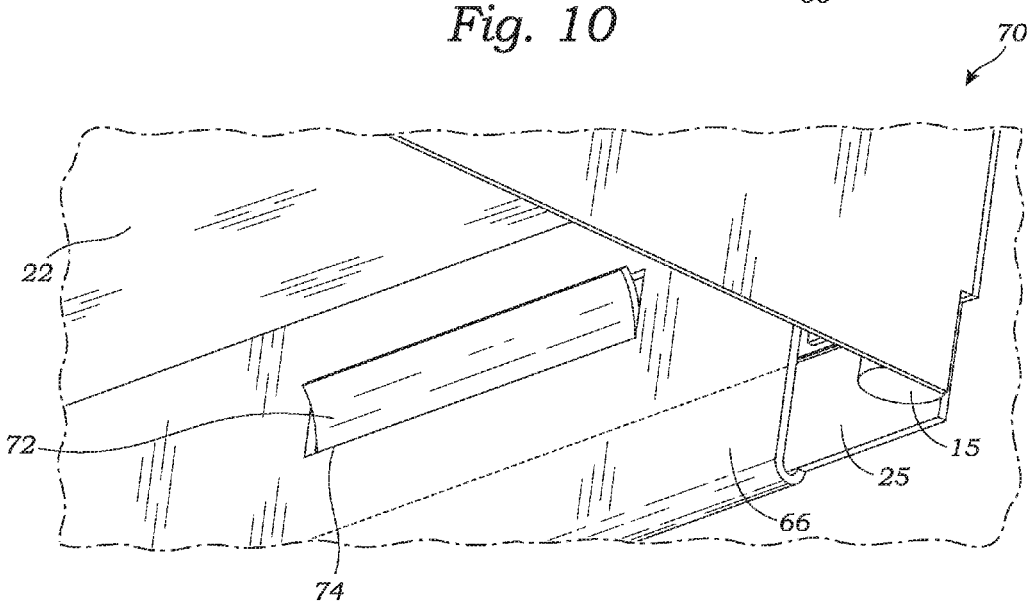
FIG. 11 is a perspective, front view of a portion of a mailbox having a sidewall of the body connected to the floor flange using one-way body notches and corresponding floor tabs, according to one embodiment of the present invention.

Turning to FIG. 11, in still another embodiment of a mailbox 70 according to the present invention, a one-way notch 74 and tab 72 are used to connect the floor 22 to the sidewalls 16 of the body 12. The mailbox 70 includes all of the basic features of the mailbox 10 described above, except that it may or may not include the rolled front edges and rod(s) 24. In addition, the mailbox 70 may include any of the compatible features of the mailboxes 30, 40, 50, and 60. FIG. 11 includes only a partial view of the mailbox 70 showing the front, right-hand corner (right as viewed from the front of the mailbox) of the mailbox 70 as viewed from the front and below the mailbox 70. It is understood that that the front, left-hand corner of the mailbox 70 is substantially a mirror image of the front, right-hand corner of the mailbox 70, and that the remainder of the mailbox 70 extending back from the partial view is the same, or substantially similar to the mailbox 10 shown in FIG. 2.

As shown in FIG. 11, each sidewall 16 is folded over the side flange 25 in a "U" shape. A sidewall extension 66 of the sidewall 16 extends upward to the bottom side of the floor 22. A tab 72 is connected to the inside surface of floor side flange 25 and extends slightly inward away from the inside surface. The tab 72 is elastic and may be angled (or "barbed") such that it can be elastically bent down in order to be inserted into the one-way notch 74, and once it is within the one-way notch 74, the tab 72 snaps into place such that it is retained by the one-way notch 74 and is difficult to remove unintentionally. For instance, the tab 72 may need to be bent down with a separate tool or manually in order to remove the tab 72 from the one-way notch 74. The sidewall extension 66 has the one-way notch 74 located opposite the location of the tab 72 which receives the tab 72. The mailbox 70 may have a plurality of these tab 72 and notch 74 structures spaced apart along the length of the floor 22 and sidewalls 16. Accordingly, the tab 72 and notch 74 structures enhance the structural connection between the floor 22 and the sidewalls 16 which increases the strength and rigidity of the mailbox 70 and improves its impact resistance.

Figure 12:
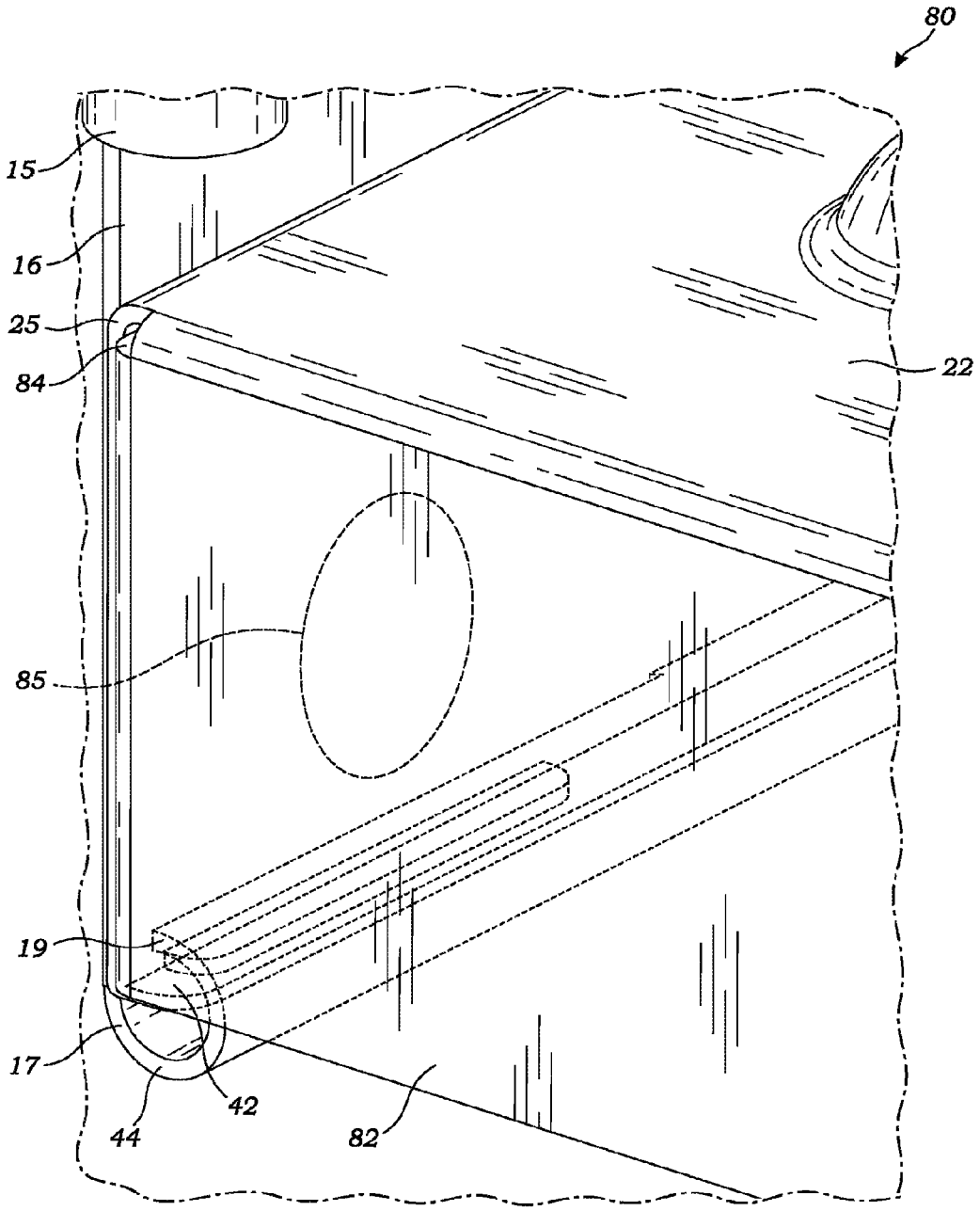
FIG. 12 is a perspective, front view of a portion of a mailbox having the front floor flange connected to the sidewalls of the body and side flanges of the floor, according to one embodiment of the present invention.

Turning to FIG. 12, in another feature of the present invention, any of the mailboxes described herein, including mailboxes 10, 30, 40, 50, 60 and 70, may also include a floor 22 having a floor front flange 82 which is connected to the floor side flanges 25 and the sidewalls 16. The mailbox 80 of FIG. 12 includes all of the basic features of the mailbox 10 described above, except that it may or may not include the rolled front edges and rod(s) 24. In addition, the mailbox 80 may include any of the compatible features of the mailboxes 30, 40, 50, 60 and 70. FIG. 12 includes only a partial view of the mailbox 80 showing the front, left-hand corner (left as viewed from the front of the mailbox) of the mailbox 80 as viewed from the front of the mailbox 80. It is understood that that the front, right-hand corner of the mailbox 80 is substantially a mirror image of the front, left-hand corner of the mailbox 80, and that the remainder of the mailbox 80 extending back from the partial view is the same, or substantially similar to the mailbox 10 shown in FIG. 2.

As shown in FIG. 12, the mailbox 80 includes the floor edge flange 42 disposed within the rolled body edge 44 configuration described above with reference to FIG. 8. The floor 22 also has a floor front flange 82 which extends downward from the front edge of the floor 22 along the front side of the floor 22. At the corner of the mailbox 80, the front edge of the sidewall 16, the front edge of the floor side flange 25 and the side edge 84 of the floor front flange 82 are all connected together along the length of the three adjacent edges. Alternatively, or in addition, the floor side flange 25, side edge 84 and sidewall 16 may be spot welded together with a spot weld 85. As the floor front flange 82 is oriented in a plane substantially parallel to the impact at Positions #3 and #4 as shown in FIGS. 1 and 5, the floor front flange 82 provides substantial resistance to the bending moment caused by the reaction force of the impact. Hence, this feature significantly improves the impact resistance of the mailbox 80.

Figure 13:
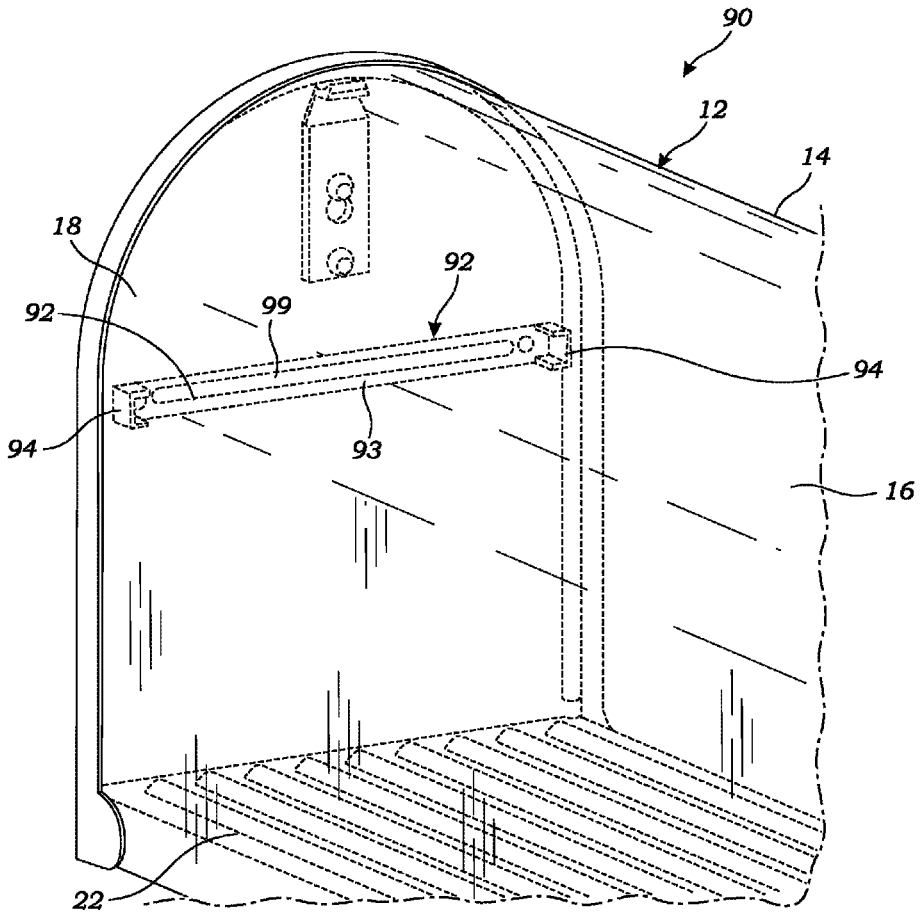
FIG. 13 is a perspective, right side view of a portion of a mailbox having a front door brace, according to one embodiment of the present invention.

Referring to FIG. 13, in another feature of the present invention, a door brace 92 may be used to reinforce the front door 18 in order to further increase the strength of the mailbox 90 and its resistance to impact. The front door of typical mailboxes, which is typically thrown open during an impact, may be used to enhance the overall structural integrity, because it can be used to support the front opening of the mailbox. However, some USPS standards may limit the open/close force of the front door to make it easier for the carriers to execute their day-to-day job. Therefore, a receptacle with a latch having enough force to retain the door in place during impact would likely exceed the maximum open/close force requirement in the USPS standards. However, a brace inside the front door that engages the body opening during impact provides additional structural support of the body mouth, without affecting the force required to open/close the door. FIG. 13 shows such a brace 92 mounted on the inside of the front door 18. The brace 92 may be positioned at various heights, but ideally is vertically positioned at approximately the mailbox centerline, coincident with the impact at Position #4 of Standard 7.

The door brace 92 may be utilized with any of the mailboxes described herein, including mailboxes 10, 30, 40, 50, 60, 70 and 80. The mailbox 90 of FIG. 13 includes all of the basic features of the mailbox 10 described above, except that it may or may not include the rolled front edges and rod(s) 24. In addition, the mailbox 90 may include any of the compatible features of the mailboxes 30, 40, 50, 60, 70 and 80. FIG. 13 includes only a partial view of the mailbox 90 showing the front portion of the mailbox 90 as viewed from the back, right side of the mailbox 90 (with the right side not shown for illustration purposes). It is understood that that the remainder of the mailbox 90 extending back from the partial view is the same, or substantially similar to the mailbox 10 shown in FIG. 2.

Figure 14:
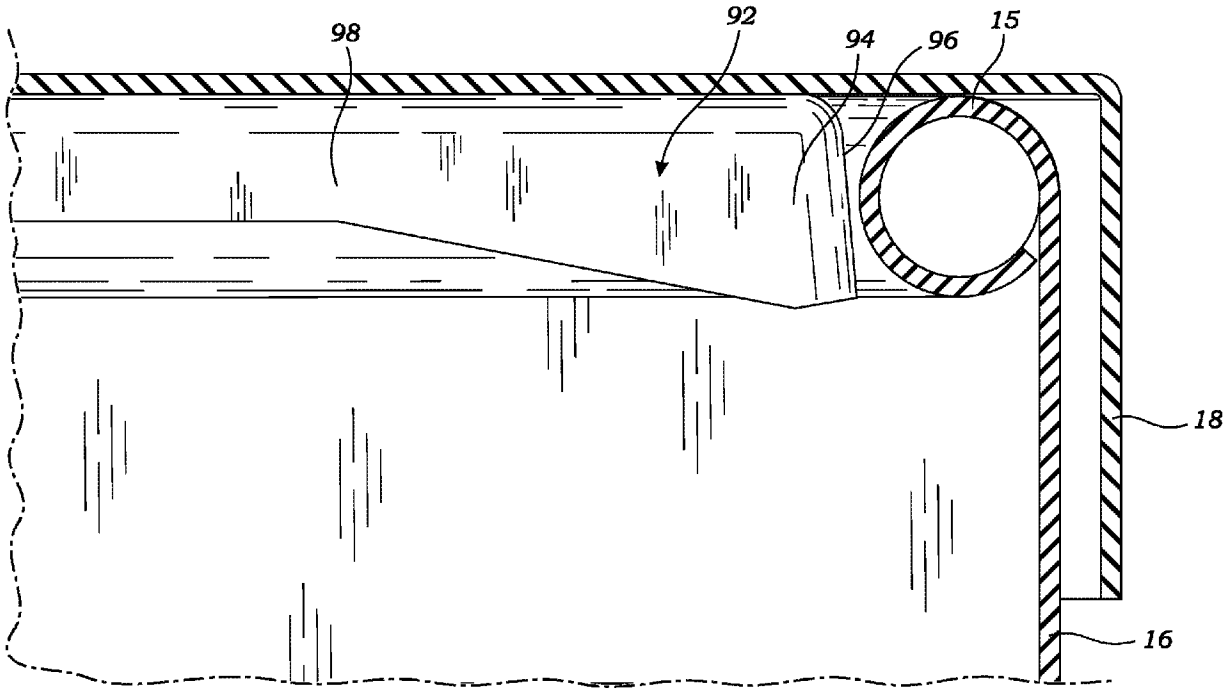
FIG. 14 is a top view of a portion of a front door brace having angled sides, according to one embodiment of the present invention.

As shown in FIG. 13, the mailbox 90 includes the door brace 92 connected to the inside surface of the front door 18. The door brace 92 extends horizontally across the entire width, or substantially the entire width of the front door 18 such that each end of the door brace 92 is very close to, or in contact with, a respective front edge 15 of the sidewall 16. For example, the embodiment of FIG. 13 includes the rolled front edges 15 of the sidewalls 16 so that each end of the door brace 92 is very close to, or bearing against, the rolled front edges 15. The brace 92 may have any suitable shape, such as a solid bar or rod, or as shown in the embodiment of FIGS. 13 and 14, the brace 92 comprises an elongated beam 93 having opposing side flanges 98 extending along the length of the beam 93 and a ridge 99 in the middle of the beam extending along the length of the beam 93. The brace 92 also has an end piece 94 on each end of the beam which extends backward and away from the beam 93. The end pieces 94 may help absorb an impact at Position #4, and accordingly prevent structural damage to the mailbox body 12.

Referring to the enlarged view of FIG. 14, the end pieces 94 of the brace 92 may have an angled surface 96 which is configured to engage the rolled front edge 15 during an impact. The angled surfaces 96 taper outward from front to back (front being the front of the mailbox 90). During an impact, as the rolled front edge 15 moves toward the angled surface 96 due to the force of the impact, the angled surface 96 forces the brace 92 toward the back of the mailbox 90 which in turn pulls the front door 18 toward the closed position, thereby preventing the front door 18 from opening during an impact.

During an impact as described above, as the body 12 distorts, the sidewalls 16 and the front edges 15 deflect toward and make contact with the end pieces 94 of the brace 92 which is mounted or otherwise attached to the inside surface of the front door 18. Once in contact, the brace 92 absorbs the impact forces and prevents the front opening of the body 12 from distorting to an inoperable degree.

Although particular embodiments have been shown and described, it is to be understood that the above description is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, not all of the components described in the embodiments are necessary, and the invention may include any suitable combinations of the described components, and the general shapes and relative sizes of the components of the invention may be modified. Accordingly, embodiments are intended to exemplify alternatives, modifications, and equivalents that may fall within the scope of the claims. The invention, therefore, should not be limited, except to the following claims, and their equivalents.

What is claimed is:

1. A mailbox comprising:

a body having a rolled front edge;

a floor having a front edge;

a front door attached to the body and the floor, the front door being moveable between an open position and a closed position; and a rod at least partially disposed within the rolled front edge.

2. The mailbox of claim 1, further comprising a door brace attached to the inside of the front door and positioned to engage the body during an impact to the mailbox.

3. The mailbox of claim 2, wherein:

the brace comprises an elongated beam and opposing side flanges extending outward from the beam, the side flanges extending along a length of the beam, and an end piece on each end of the beam; and the brace is positioned horizontally across a width of the front door.

4. The mailbox of claim 3, wherein each end piece has an angled surface configured to engage the body, each of the angled surfaces tapered outward as they extend in a direction from front to back of the mailbox.

5. The mailbox of claim 3, wherein the rod is magnetic.

6. A mailbox comprising:

a body having a top and opposing sidewalls extending downward from the top, the sidewalls having a body edge at a bottom portion of the sidewalls extending along a length of the sidewalls;

a floor having a bottom portion and opposing side flanges extending downward from the bottom portion, each side flange having a floor edge at the lower portion of each side flange extending along the length of the floor;

a front door attached to the body and the floor, the front door being movable between an open position and a closed position;

a door brace attached to the inside of the front door and positioned to engage the body during an impact to the mailbox, the brace comprising an elongated beam and opposing side flanges extending outward from the beam, the side flanges extending along a length of the beam, and an end piece on each end of the beam, the brace positioned horizontally across a width of the front door; and wherein the body edges are rolled together with the floor edges along the length of the floor.

7. The mailbox of claim 6, wherein each end piece has an angled surface configured to engage the body, each of the angled surfaces tapered outward as they extend in a direction from front to back of the mailbox.

8. A mailbox comprising:

a body having a top and opposing sidewalls extending downward from the top, the sidewalls having a body edge at a bottom portion of each of the sidewalls extending along a length of each of the sidewalls, each body edge rolled to form a rolled body edge;

a floor having a bottom portion and opposing side flanges extending downward from the bottom portion, each side flange having a floor edge at the lower portion of each side flange extending along the length of the floor, and each floor edge having a floor edge flange extending along a length of the floor, each floor edge positioned within a respective rolled body edge;

a front door attached to the body and the floor, the front door being movable between an open position and a closed position; and a door brace attached to the inside of the front door and positioned to engage the body during an impact to the mailbox, the brace comprising an elongated beam and opposing side flanges extending outward from the beam, the side flanges extending along a length of the beam, and an end piece on each end of the beam, the brace positioned horizontally across a width of the front door.

9. The mailbox of claim 8, wherein each end piece has an angled surface configured to engage the body, each of the angled surfaces tapered outward as they extend in a direction from front to back of the mailbox.

10. A mailbox comprising:

a body having a top and opposing sidewalls extending downward from the top, the sidewalls having a body edge at a bottom portion of each of the sidewalls extending along a length of each of the sidewalls, each body edge rolled to form a rolled body edge;

a floor having a bottom portion and opposing side flanges extending downward from the bottom portion, each side flange having a floor edge at the lower portion of each side flange extending along the length of the floor, and each floor edge having a floor edge flange extending along a length of the floor, each floor edge positioned within a respective rolled body edge; and a front door attached to the body and the floor, the front door being movable between an open position and a closed position;

the floor further comprising a floor front flange extending downward from the bottom portion of the floor at a front of the mailbox;

the floor front flange having front flange side flanges on either side of the front flange; and the floor flange side flanges connected to the respective sidewalls and the respective side flanges extending downward from the bottom portion.

11. A mailbox comprising:

a body having a top and opposing sidewalls extending downward from the top, the sidewalls having a body edge at a bottom portion of the sidewalls extending along a length of the sidewalls;

a floor having a bottom portion and opposing side flanges extending downward from the bottom portion, each side flange having a floor edge at the lower portion of each side flange extending along the length of the floor;

a front door attached to the body and the floor, the front door being movable between an open position and a closed position; and a door brace attached to the inside of the front door and positioned to engage the body during an impact to the mailbox, the brace comprising an elongated beam and opposing side flanges extending outward from the beam, the side flanges extending along a length of the beam, and an end piece on each end of the beam, the brace positioned horizontally across a width of the front door.

12. The mailbox of claim 11, wherein the body edge is hemmed together with the floor edge along the length of the floor.

13. The mailbox of claim 11, wherein each end piece has an angled surface configured to engage the body, each of the angled surfaces tapered outward as they extend in a direction from front to back of the mailbox.

14. The mailbox of 11, wherein:

one of a tab or a slot is connected to the floor;

the other of the tab or the slot is connected to one of the sidewalls; and the tab is inserted into the slot thereby retaining the tab in the slot.

15. The mailbox claim 11, wherein one of a tab or a one-way notch is connected to the floor;

the other of the tab or the one-way notch is connected to one of the sidewalls; and the tab is inserted into the one-way notch thereby retaining the tab in the one-way notch.

* * * * *